US005680729A

United States Patent [19]

Heffington

[11] Patent Number: 5,680,729

[45] Date of Patent: Oct. 28, 1997

[54] SYSTEM FOR OPENING AND CLOSING A GATE

[75] Inventor: Rodger T. Heffington, Houston, Tex.

[73] Assignee: The Pickwick Corporation, Houston, Tex.

[21] Appl. No.: 386,284

[22] Filed: Feb. 9, 1995

[51] Int. Cl.[6] ..... E05F 11/34

[52] U.S. Cl. ..... 49/362

[58] Field of Search ..... 49/360, 361, 362

[56] References Cited

U.S. PATENT DOCUMENTS

| | | | |
|---|---|---|---|
| 1,011,893 | 12/1911 | Rasmussen | 49/362 |
| 1,132,683 | 3/1915 | Peterson | 49/361 X |
| 1,344,776 | 6/1920 | Strieter | 49/361 X |
| 1,757,751 | 5/1930 | Strauss | 49/361 |
| 1,997,175 | 4/1935 | Gussack | 268/52 |
| 2,336,530 | 12/1943 | Chandler et al. | 49/361 X |
| 2,531,116 | 11/1950 | Donoghue | 49/361 X |
| 3,257,756 | 6/1966 | Mealer | 49/264 |
| 3,289,350 | 12/1966 | Moody | 49/362 X |
| 3,775,906 | 12/1973 | Dougherty | 49/360 X |
| 4,188,752 | 2/1980 | Monot | 49/218 |
| 4,336,670 | 6/1982 | Brutosky | 49/409 |
| 4,366,649 | 1/1983 | Weigant | 49/362 |
| 4,858,383 | 8/1989 | Kendig | 49/360 |
| 4,977,704 | 12/1990 | Koenig | 49/362 |
| 5,146,712 | 9/1992 | Hiavaty | 49/360 X |
| 5,261,187 | 11/1993 | Prenger | 49/362 |

*Primary Examiner*—Kenneth J. Dorner
*Assistant Examiner*—Jerry Redman
*Attorney, Agent, or Firm*—Vinson & Elkins L.L.P.

[57] ABSTRACT

A system for opening and closing a gate or door which includes a sprocket and a perforated rigid strip of material. The perforated rigid strip of material is mounted to the gate or door. The sprocket is positioned so that the teeth of the sprocket will engage the perforations in the rigid strip. Therefore, when the sprocket is rotated the rigid strip will be moved by the sprocket thus causing the gate or door to open or close.

14 Claims, 9 Drawing Sheets

SYSTEM FOR OPENING AND CLOSING A GATE

FIELD OF THE INVENTION

The present invention is particularly directed to a system for opening and closing a gate or door; and generally directed to any system in which a roller chain may have been used for linear activation such as in a conveyor belt or system having linear reciprocating motion.

BACKGROUND OF THE INVENTION

Gates or doors are encountered by most individuals many times during an average day. At apartment complexes and business facilities, horizontally sliding gates are frequently used at vehicle or pedestrian entrances. These horizontally sliding gates may have either support wheels which traverse a track or a cantilevered mounting where the sliding gate is supported only at one end. As security has become more of a concern, the use of horizontally sliding gates has increased dramatically. Typically, horizontally sliding gates are automatically moved by a mechanism including a roller chain and sprocket assembly. The roller chain and sprocket assembly operates by the sequential engagement of the sprocket's tapered teeth with the spaces between the links of the roller chain. Thus, as the sprocket is rotated the roller chain is drawn past the sprocket. When the roller chain is attached to each end of a gate, the movement of the roller chain by the rotating sprocket causes the gate to either open or close.

While the roller chain and sprocket assembly for moving a horizontally sliding gate has received wide acceptance, there is still substantial room for improvement. Specifically, the use of roller chain as a means for opening and closing a horizontally sliding gate presents many problems. First, roller chains can only be used over relatively short spans as their own weight and flexibility causes them to droop or sag if used over long spans. Second, over a period of time, the roller chain will stretch, or the bolts which attach the roller chain to the gate or adjust chain tension become loose. When the roller chain stretches or the roller chain tension is relaxed, the roller chain will droop or sag to where it either contacts the ground or other parts of the gate. Such contact with the ground or other parts of the gate may damage either the roller chain or the gate. Roller chains, particularly those which are allowed to drag along the ground, become clogged with dirt or debris. In cold climates, ice or snow on the roller chain links may add to the problems caused by dirt or debris.

Roller chains are typically made from many small pieces of material, usually metal. As each link is a flexible, load-handling bearing, roller chain links can easily break apart one from another. A single break renders the chain ineffective. Such chain link breakage occurs more frequently when the roller chain becomes worn from improper lubrication or exposure to the elements. Most dangerous about roller chain breaks are the sharp edges which may either cut or scratch those who come near the broken roller chain. In some case, such sharp edges may catch on clothing and drag a person along the path of the moving chain. For these reasons, roller chains used on sliding gates should be regularly checked for breakage, cleaned, lubricated and tensioned as often as required. Unfortunately, such maintenance rarely occurs. Thus, gate opening chains frequently become inoperative and must be replaced.

For sliding gates in high traffic areas, the need for frequent maintenance or replacement of the roller chain on a horizontally sliding gate is a continuing problem. Roller chains are easily cut with bolt cutters by vandals or thieves. Once a roller chain is cut, there is a potential failure of the security function for which the gate was installed. In addition to causing inconvenience, gates with broken roller chains may be totally inoperable. Such inoperable gates can be a major safety hazard in a fire, flood, or other emergency. When a chain is cut or broken the only way to operate the gate may be to disconnect the roller chain. Of course, any time that the chain is either disconnected or missing because of maintenance, repair or vandalism, security is compromised. There is, therefore, a need to overcome the problems associated with the use of roller chain in gate opening systems.

In some applications a gear and rack assembly has been used to operate a sliding gate or door. A gear and rack assembly operates by the precise meshing or engagement of the teeth of the gear with the teeth of the rack, like the precise engagement of the pieces of a jigsaw puzzle or the teeth on a zipper. While a gear and rack assembly is not plagued with some of the problems presented by the roller chain, such as stretching and drooping, the gear and rack assembly requires precision engagement of teeth and frequent lubrication to assure proper operation. Specifically, the teeth of the gear must mesh intimately with the spaces between the teeth on the rack. Thus, if the rack shifts even a small amount in relation to the gear, which shifting may occur due to such things as gravity, loosening of mechanical parts, or obstacles in the gate's slide path, the gear and rack assembly may no longer intermesh properly, thus rendering the gate inoperable. Additionally, a buildup of dirt or ice on either the gear or rack can prevent the required precision intermeshing of the gear and rack. Also, the size and shape of the teeth on the gear and the teeth on the rack must be identical. Discrepancies in the size or shape of either the gear teeth or the rack teeth, caused by chipping or wear due to improper lubrication or breakage can hamper operation. Thus, gates and doors using gear and rack assemblies are typically used in controlled climate environments where they can be frequently checked, adjusted, and maintained with proper lubricants.

To alleviate the meshing problems between gears and racks caused by obstacles in the gates' slide path, U.S. Pat. No. 5,261,187 suggests a resiliently mounted rack. However, this rack only flexes in one dimension (up and down). It does not account for meshing discrepancies caused by movement of the gate in the other two dimensions (back and forth and side to side). It also does not address the problems created by the buildup of din or ice. Additionally, this apparatus has movable parts which may loosen or breakdown in operation.

U.S. Pat. No. 3,257,756 teaches using a rack gear as one part of a complex multiple component power driven wheeled gate. Therein, the rack gear is made of two parallel planar surfaces interconnected at their tops by multiple crossbars. While this apparatus allows flexing from side to side, it still requires precision meshing of the gear and rack in the other two dimensions (up and down and back and forth). In addition to lacking flexibility in the other two dimensions, this apparatus is also manufactured from a multitude of small pieces thus increasing the potential for breakdowns.

There remains therefore a need in the art for a dependable, low maintenance high security system for opening and closing gates and doors which does not utilize a chain and does not require the precision of a gear and rack assembly.

SUMMARY OF THE INVENTION

The present invention is directed to a system for opening and closing a gate or door that satisfies the need for a dependable, low maintenance system which does not utilize a roller chain and does not require the precision of a gear and rack assembly. While the present invention is explained with regard to its use for opening and closing gates or doors, it will be understood that it has applicability to any system in which a roller chain is used for linear or reciprocating movement.

The system for opening and closing a gate or door of the present invention includes a sprocket and a perforated rigid strip of material. The rigid strip of material is mounted to the gate or door. As the sprocket is rotated, the tapered sprocket teeth sequentially engage the perforations in the rigid strip which in turn causes the gate or door to open or close.

Because the precision engagement normally associated with a gear and rack assembly is not required in the present invention, a less precision sprocket or toothed wheel can be used to engage the perforations in the rigid strip of material. It is preferable that the teeth on the sprocket or toothed wheel be tapered. Such tooth taper will facilitate penetration of the perforations in the rigid strip even if the perforations are not perfectly aligned with the tapered teeth. Additionally, tapered teeth can poke through ice, debris, or dirt which may clog the perforations in the rigid strip, thus providing the rigid strip of material and sprocket with a self-cleaning function. The motor which rotates the toothed wheel or sprocket can be positioned on an adjustably positionable mounting platform, thereby allowing easy horizontal and vertical adjustment of the position of the toothed wheel or sprocket in relation to the rigid strip.

The rigid strip of the present invention may have either one or two planar surfaces. One planar perforated surface may be used when the rigid strip is made part of a door or gate. Two planar surfaces, one perforated, the other for mounting, may be used when the rigid strip is mounted to a door or gate.

The simple structure of the gate opening system of the present invention has less propensity to fail than prior art rack systems or chains. This is because the rigid strip is effectively one piece of material, thus virtually eliminating the stretch related breakdowns which plague roller chains and multi-piece rack systems. Also, the solid construction of the rigid strip will not permit it to be easily cut or circumvented by thieves or vandals.

The rigid strip need not be manufactured to the tight dimensional tolerances required of a rack and gear assembly. The. perforations in the rigid strip can be shaped in a variety of ways, the only requirements being that the pitch of the perforations be substantially equal to the pitch of the sprocket teeth and the size of the openings be larger than the teeth which engage them. There is no requirement that the shape of the perforations in the rigid strip be a mirror image of the shape of the teeth on the sprocket or toothed wheel In fact, the imprecise meshing of the sprocket teeth or toothed wheel with the perforations in the rigid strip allowed by the present invention permits the gate to flex in all three dimensions without affecting the operability of the disclosed gate operating system.

In the preferred embodiment of the gate opening and closing system of the present invention, a hydraulic system is used to power a hydraulic motor which turns the sprocket which engages the rigid strip of material. Such hydraulic system has particular advantages in that the speed of gate travel may be easily regulated and the system is operable in extreme climate conditions. The size and power of the hydraulic motor and hydraulic system will depend on the size of the gate.

An advantage of the present gate operating system is that it provides more dependable operation than other systems and requires less maintenance and provides greater operational security.

Another advantage of the present system is that it operates in spite of dirt, ice, or other debris which would interrupt operation of a gate using a chain and sprocket assembly or a gear and rack assembly.

Yet another advantage of the present system is that there is a minimal chance for injury to the gate operator or bystanders or damage to nearby property.

A further advantage of the present invention is that it does not require precise intermeshing of gear teeth to perform well.

Still another advantage of the present invention is that it provides added physical security to the opening and closing system because the rigid strip is not easily cut or tampered with.

Yet another advantage is that the present invention allows movement of the gate or door in all three dimensions while still operating satisfactorily.

A still further advantage is that the present system is partially self-cleaning.

Another advantage is that the present system is adaptable for use on many types of doors or gates even those gates or doors having extended length to secure wide openings.

Still another advantage is that the present system may be added to gates or doors already in operation without need to extensively modify the existing gate or door.

BRIEF DESCRIPTION OF THE DRAWINGS

These and other features, aspects, and advantages of the present invention will become better understood with regard to the following description, appended claims and accompanying drawing where:

DESCRIPTION OF EMBODIMENTS

Figure 1:
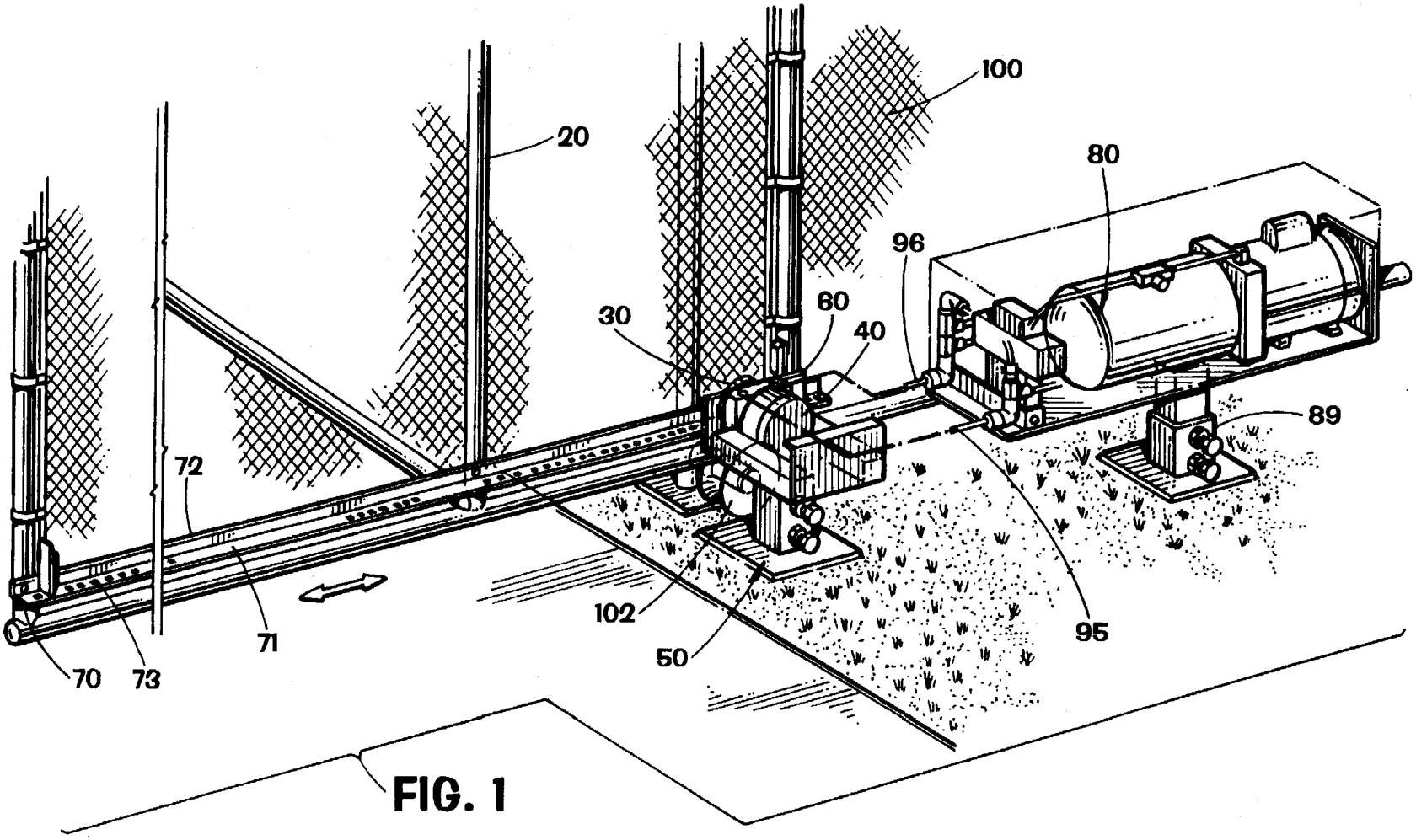
FIG. 1 is a perspective view of the gate or door opening and closing system as seen from inside the enclosed property.

In FIG. 1, a gate 20 is positioned to secure an opening in a chain link fence 100. The gate 20 is shown in the closed position. While shown in association with a sliding gate 20 in a chain link fence supported by a roller 102, it will be understood by those of ordinary skill in the art that the present invention may also be adapted for use on many other types of gates and doors. A perforated rigid strip 70 is mounted to the gate 20. A sprocket or toothed wheel 30 is positioned adjacent to the gate 20 on an adjustable mounting platform 50. The sprocket 30 may also be a toothed wheel or any type of wheel having projections located around its circumference at regular intervals. The projections may be any size or shape as long as they engage the perforations 73 in the rigid strip 70. The precision of a gear is not required. The sprocket 30 is attached to the shaft 31 (FIG. 5) of a bi-rotational hydraulic motor 40, which is mounted on an adjustable mounting platform 50. FIG. 1 shows the positioning of the adjustable mounting platform 50 adjacent to the gate 20 near the junction of the gate 20 and the fence 100, such that the sprocket 30 may engage the perforations 73 along the entire length of the rigid strip 70.

Figure 1A:
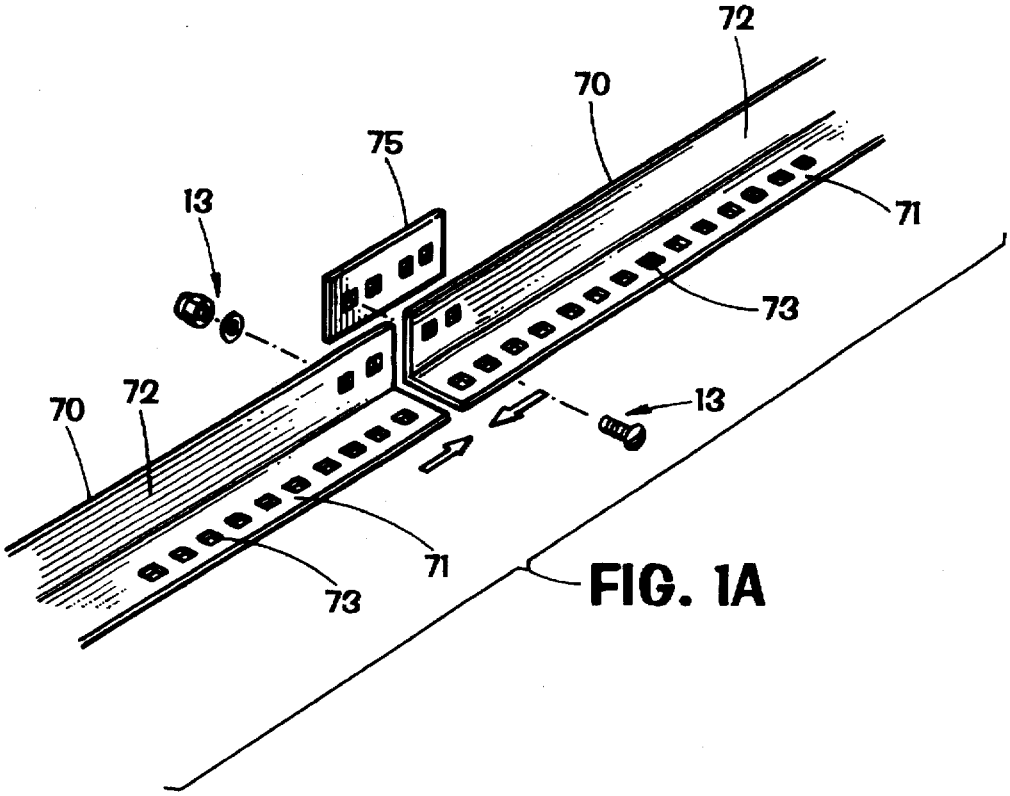
FIG. 1A is a detail view illustrating the connection of sections to make a single rigid strip of material.

Mounted to the gate 20 by a plurality of threaded fasteners 75 is a rigid strip of material 70, specifically an angle iron having two substantially perpendicular planar surfaces 71 and 72. The substantially horizontal planar surface 71 contains a plurality of perforations 73. The substantially vertical planar surface 72 is used to mount the angle iron 70 to the gate 20. For long gates used to secure wide openings, several separate strips of rigid perforated material may be mechanically secured together end to end as shown in FIG. 1A utilizing a nut and bolt assembly 73 with a backing plate 75. Alternatively, such shorter strips of rigid material may be welded together or individually bolted to the gate or door being opened and closed. It will be understood that while a threaded fastener assembly 13 is used in the preferred embodiment, any other means for mounting the angle iron 70 to the gate 20 may also be used such as welding, clipping, tying, or fabricating a gate 20 wherein the rigid strip 70 is actually made part of the gate 20. The size of rigid strip 70 depends on the size and weight of the gate or door being moved. To modify existing gate opening systems employing roller chain and sprocket systems, the rigid strip 70 is used to replace the chain. The rigid strip 70 can also be added to gates or doors which currently use other systems without the need to perform extensive modification to the existing gate or door.

In the preferred embodiment, a hydraulic system 80 is used to supply power to the hydraulic motor 40. The hydraulic system 80 may also be mounted on an adjustable mounting platform 89. The hydraulic system 80 may be located near the gate 20 as shown in FIG. 1 or may be located at a location remote from the gate 20. If located at a location remote from the gate 20, the two hydraulic lines 95 and 96 which supply the hydraulic motor 40 with pressurized hydraulic fluid may be buried. In severe cold climates, it will be preferable to bury hydraulic lines 95 and 96 below the freeze line and use heated tape around the hydraulic motor 40. While other means for rotating the sprocket 30 such as an electric or air motor may also be used, a hydraulic system including a hydraulic motor has been used in the preferred embodiment because hydraulic systems provide the most flexible and versatile operational control.

Figure 2:
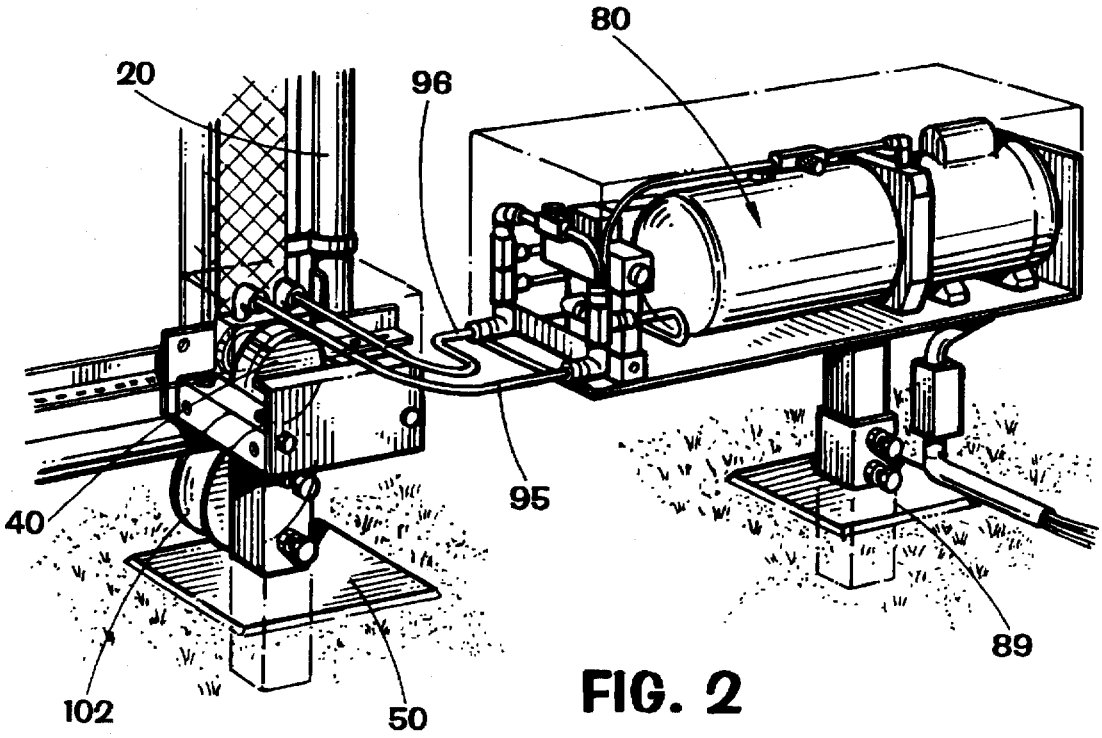
FIG. 2 is a more detailed perspective view of the system as shown in FIG. 1.

In FIG. 2, two hydraulic fluid lines 95 and 96 connect the hydraulic system 80 to the hydraulic motor 40. For added security, the hydraulic fluid lines 95 and 96 may be made from stainless steel or if hydraulic lines 95 and 96 are covered or protected, a sorer material may be used. The hydraulic motor 40 is shown in FIG. 2 mounted on an adjustable mounting platform 50. However, the hydraulic motor 40 can be supported on a stationary platform or positioned adjacent to the gate 20 in a variety of ways well known to those of ordinary skill in the art.

Figure 3:
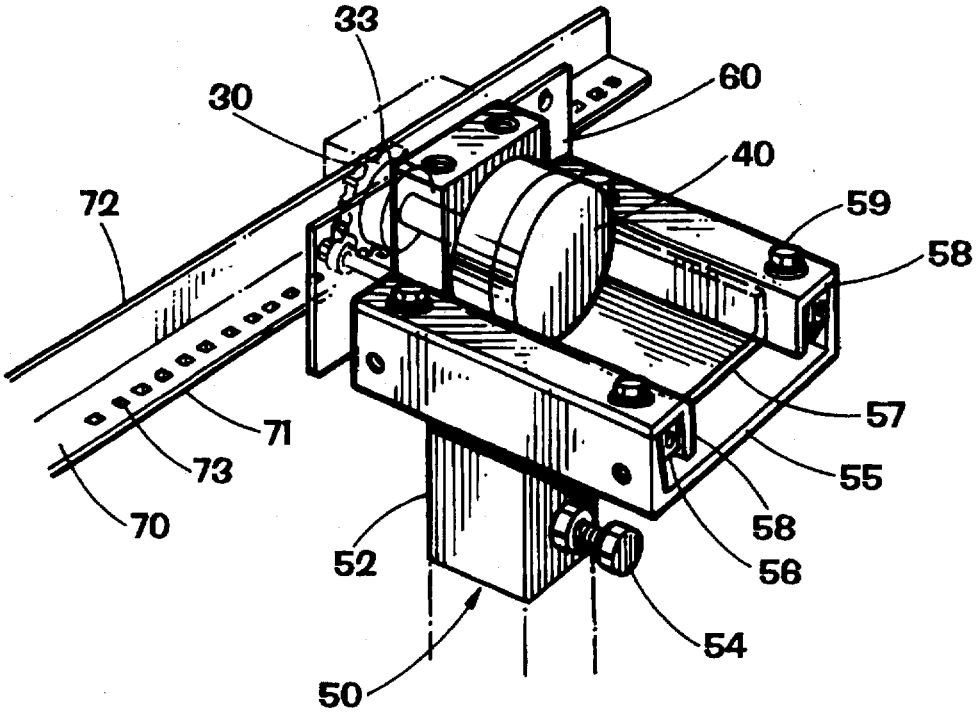
FIG. 3 is a perspective view from the left side of the invention, showing the rotary power means, and its adjustable mounting platform.

In FIG. 3, the rigid strip 70 can be seen in more detail. Specifically, the rigid strip 70 includes a plurality of substantially square perforations 73 in the substantially horizontal planar surface 71. It is by the engagement of the perforations 73 with the tapered teeth 33 on sprocket 30 that the strip 70 is caused to move, thus opening or closing the gate 20. In the preferred embodiment of this invention, the perforations 73 in the rigid strip 70 are substantially square. A substantially square shaped perforation allows the gate 20 to move in all three dimensions (side to side, back and forth, and up and down) while the system operates satisfactorily. The "imprecise" manner of penetration of the perforations 73 by the tapered teeth 33 of the sprocket 30 provides one of the key features of this invention. This "imprecise" penetration feature allows the gate or door 20 to operate without the precise engagement normally found in a gear and rack assembly. For example, the tapered teeth 33 of the sprocket 30 can engage the perforations 73 in a more or less deep manner, thus allowing the gate 20 to move up or down without interfering with the operation of the gate opening system. The square shape of perforations 73 also allows for movement of the gate 20 from side to side. The tapered teeth 33 being smaller than the perforations 73 will still engage the perforations 73 in spite of back and forth movement of the gate 20. Therefore, the size and shape of perforations 73 allow operation of the gate 20 despite movement of the gate 20 in any direction.

FIG. 3 also shows the horizontally adjustable mounting for the hydraulic motor 40 on the top of the platform 50.

Figure 4:
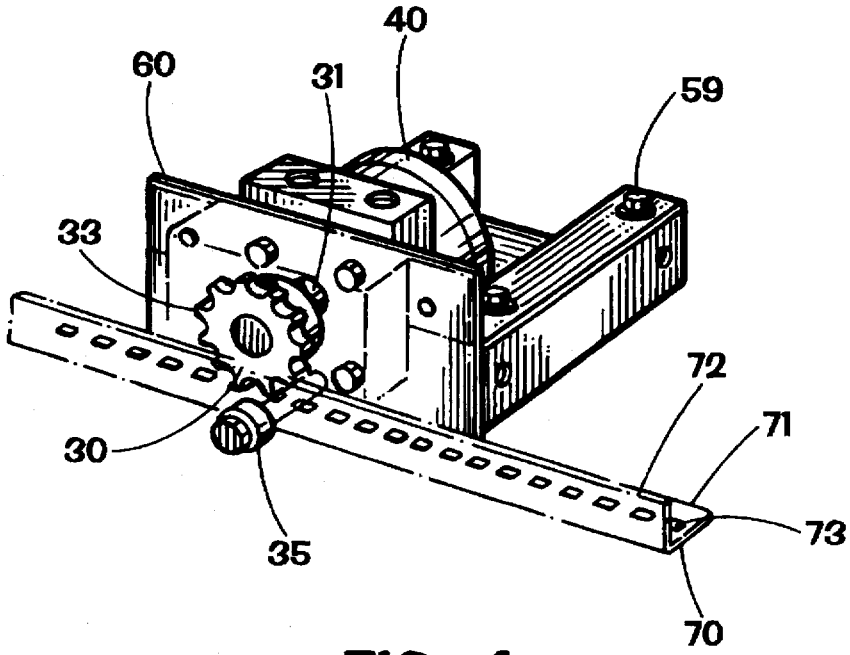
FIG. 4 is a front perspective view showing the penetration of the perforated rigid strip by the projections on the sprocket and the roller support beneath the rigid strip.

In FIG. 4, the positioning of the rigid strip 70 with respect to the sprocket 30 is shown. The substantially horizontal planar surface 71 of the rigid strip 70 passes under the sprocket 30 as the projections 33 of the sprocket 30 sequentially engage the perforations 73 in the planar surface 71. The substantially vertical planar surface 72 of the rigid strip 70, and the gate or door 20 to which it is attached pass parallel to the sprocket 30 as the perforations 73 of the rigid strip 70 are engaged by the projections 33 of the sprocket 30. While the rigid strip 70 is shown passing under the sprocket 30, it will be understood by those of ordinary skill in the art that the rigid strip 70 could also pass over or alongside the sprocket 30. In the preferred embodiment, a rotating bearing 35 urges the rigid strip 70 into engagement with the sprocket 30. While a rotating bearing 35 is shown in the preferred embodiment, a variety of mechanisms can be used to urge the rigid strip 70 into alignment with the sprocket 30 such as a stationary piece of material with a friction resistant coating.

Figure 5:
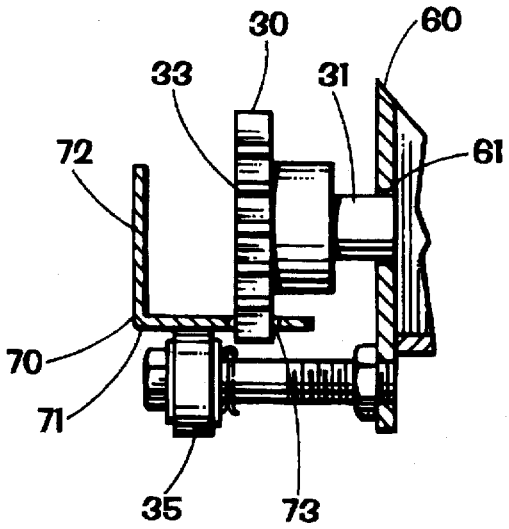
FIG. 5 is a side cross-sectional view taken along line 5—5 of FIG. 4 depicting the engagement of the sprocket with the perforated strip.

FIG. 5 shows the sprocket 30 connected to a shaft 31 of the hydraulic, motor 40. A rotating bearing 35 is attached to a motor mounting plate 60. The rotating bearing 35 may be positioned near the sprocket 30 using other means including an independent mounting. It is important to note that the rigid strip 70 may move up and down (along a y or a vertical axis in FIG. 5) or from side to side (along an x or a horizontal axis in FIG. 5) and the tapered teeth 33 of the sprocket 30 will still engage the perforations 73 (FIG. 4) of the rigid strip 70. The range of movement permitted along the y axis corresponds to the length of each tooth 33 on the sprocket 30. The range of movement permitted along the x axis corresponds to the width of each perforation 73 in the rigid strip 70.

Figure 6:
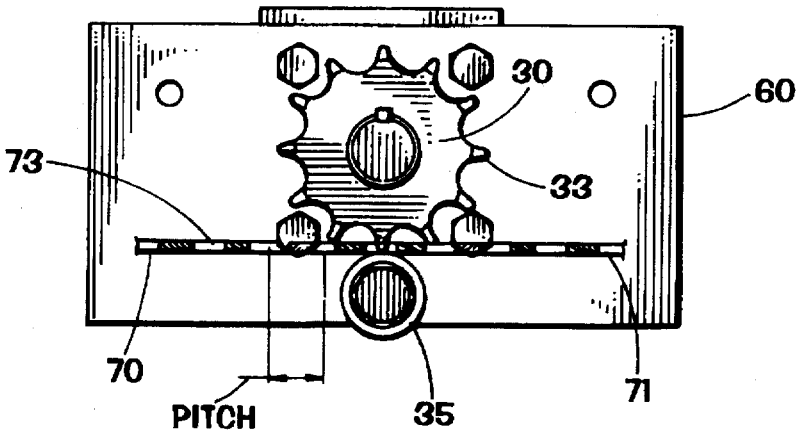
FIG. 6 is a detailed front cross-sectional view taken along line 6—6 of FIG. 5.

As shown In FIG. 6, the pitch of the teeth on the sprocket 30 and the pitch of the perforations 73 in the rigid strip 70 are substantially equal. Although the pitches of the teeth on the sprocket 30 and the rigid strip 70 are substantially equal, the width of each tapered tooth 33 is smaller than the width of each perforation 73. This difference in width allows the rigid strip 70 to move back and forth without affecting the ability of the sprocket teeth 33 to sequentially engage the perforations 73, thus causing the gate or door 20 to which the rigid strip 70 is mounted to open and close. While the system operates best when the perforations 73 are centrally aligned with the sprocket teeth 33, the system will still operate satisfactorily as long as the sprocket teeth 33 can sufficiently engage the perforations 73. This "imprecise" engagement is a key feature of the invention.

Figure 7:
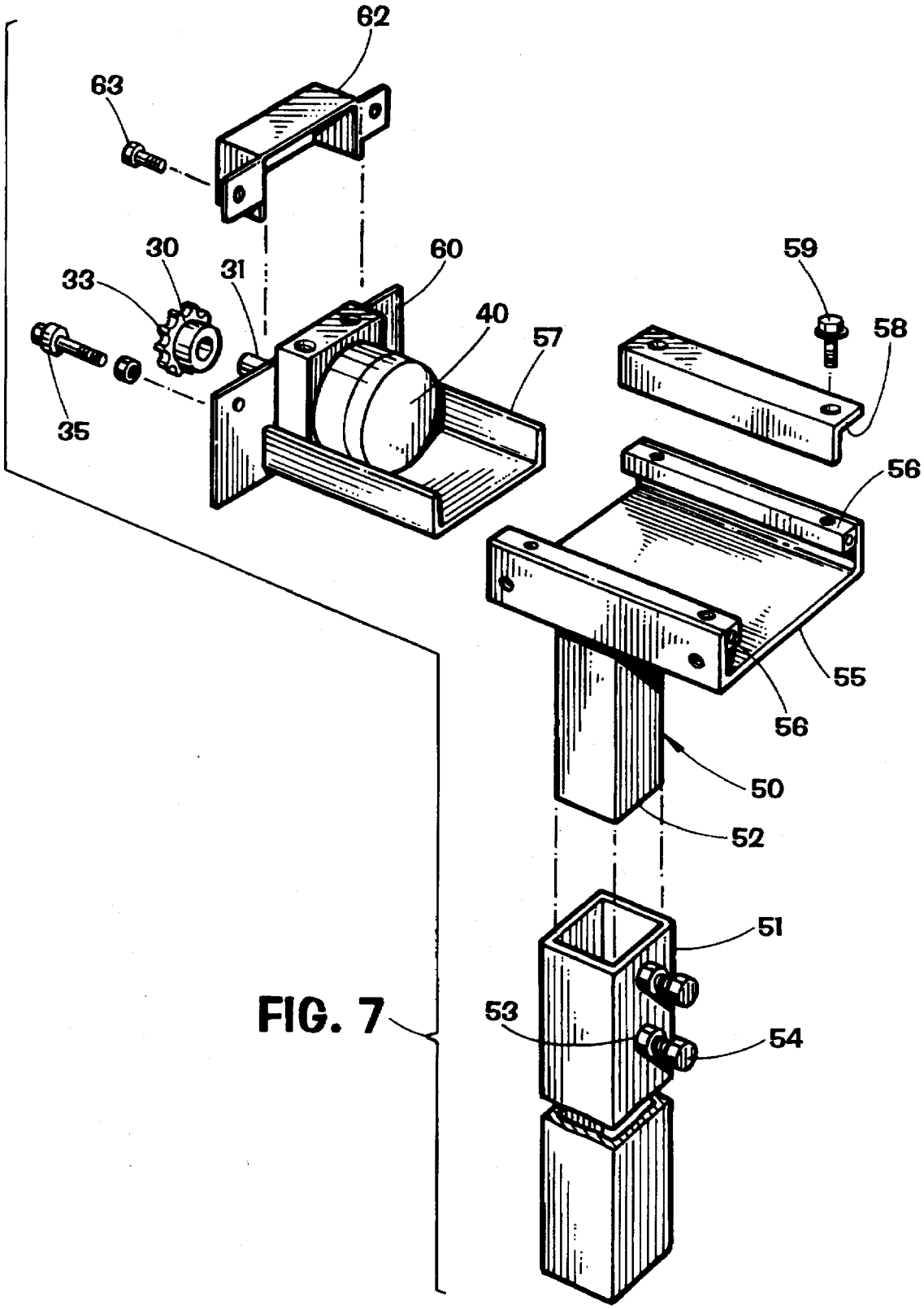
FIG. 7 is an exploded perspective view of the adjustable mounting platform.

In FIG. 7 the component parts of the adjustable mounting platform 50 are shown. The adjustable mounting platform 50 is constructed by permanently affixing a first vertical section of hollow pipe or tubing 51 in the ground or surface adjacent to a gate or door. The first pipe or tubing section 51 can be affixed by means of cement, hamering into the ground, bolting to a hard surface, or any other suitable manner. A second piece of hollow pipe or tubing 52, sized to fit inside of the first hollow pipe or tubing section 51, is positioned inside of the first pipe section 51. The first pipe section 51 has at least one hole 53 drilled through its outer surface so that a bolt or screw 54 can be placed through the hole 53 and tightened against the second piece of hollow pipe 52 to hold it at the desired level. This provides vertical adjustability of the mounting platform 50. Permanently affixed to the top (one end) of the hollow pipe 52 is a tray 55. The tray 55 may be welded to the second piece of pipe 52 or secured in any other suitable manner. The tray 55 is generally of a "U" or channel shape with a bottom and two sides. Both ends of the tray 55 remain open. Attached to the inner surfaces of both sides of the tray 55 are bars 56. A second tray or channel section 57 is constructed or selected to slidably fit within the tray 55 in contact with the bars 56. Two wings 58 (right side shown in FIG. 7) preferably sections of angle iron, are placed over the sides of the tray 57 and then tightened against the tray 57 by means of screws 59 which secure the wings 58 to the bars 56. This provides horizontal adjustability of the tray 57 of the adjustable mounting platform 50. At one end of the slidable tray 57, a motor mounting plate 60 is attached by welding, screws, nuts and bolts, or other suitable means. A hole 61 is drilled through the motor mounting plate 60 so that the shaft 31 of the hydraulic motor 40 may be inserted through the motor mounting plate 60 and attached to the sprocket 30, leaving the sprocket 30 free to rotate outside of the tray 57. The hydraulic motor 40 is affixed inside of the tray 57. Thus, when the slidable tray 57 is moved, the hydraulic motor 40 and the sprocket 30 also move either closer to or farther from the gate 20. An optional bonnet 62 can be used to cover the sprocket 30 to protect it from dirt, water, or vandalism. The bonnet 62 is shaped to provide sufficient room for the sprocket 30 to rotate freely and is attached to the plate 60 by some threaded fasteners 63.

In order to practice the disclosed method of moving a gate or door of the present invention the following steps should be taken:

The rigid strip 70 is mounted to the gate or door 20 using several threaded fasteners 13. Specifically, the rigid strip 70 should be mounted approximately parallel to the ground or the bottom surface of the gate 20, at a level such that the sprocket 30 can easily engage the perforations 73 of the rigid strip 70. Next, the tubing 51 portion of the adjustable mounting platform 50 is secured in the ground or on a surface adjacent to the gate 20. The adjustable mounting platform 50 and the rigid strip 70 should be located inside the fenced property for maximum security. For complete opening of the gate 20, the adjustable mounting platform 50 should be placed near the junction of the gate 20 and the fence 100 on the side of the fence 100 that the gate 20 overlaps when in the open position. The adjustable mounting platform 50 is positioned at a distance from the gate 20 such that the sprocket 30 may easily engage the rigid strip 70. Next, slide the end of tubing 52 which is opposite the tray 55 inside of the first tubing section 51 and tighten the screws 54 through the holes 53 against the second section of tubing 52. The hydraulic motor 40 is then secured within the slidable tray 57 on the adjustable mounting platform 50 with the motor shaft 31 extending through the hole 61 (FIG. 5) in the motor mounting plate 60. The sprocket 30 is attached to the shaft 31 of the hydraulic motor 40. The smaller tray 57 is slid into the larger tray 55 and then tightened into its desired position using the wings 58. The tapered teeth 33 of the sprocket 30 should now be in engagement with the perforations 73 in the rigid strip 70. The hydraulic system 80 is mounted in its desired location on the adjustable mounting platform 89. The hydraulic system 80 is connected to the hydraulic motor 40 using the two hydraulic lines 95 and 96. Once the hydraulic system 80 is activated, which powers the hydraulic motor 40 and causes the sprocket 30 to rotate, the tapered teeth 33 will sequentially penetrate the perforations 73 of the rigid strip 70, thus causing the gate 20 to open and close.

Figure 8:
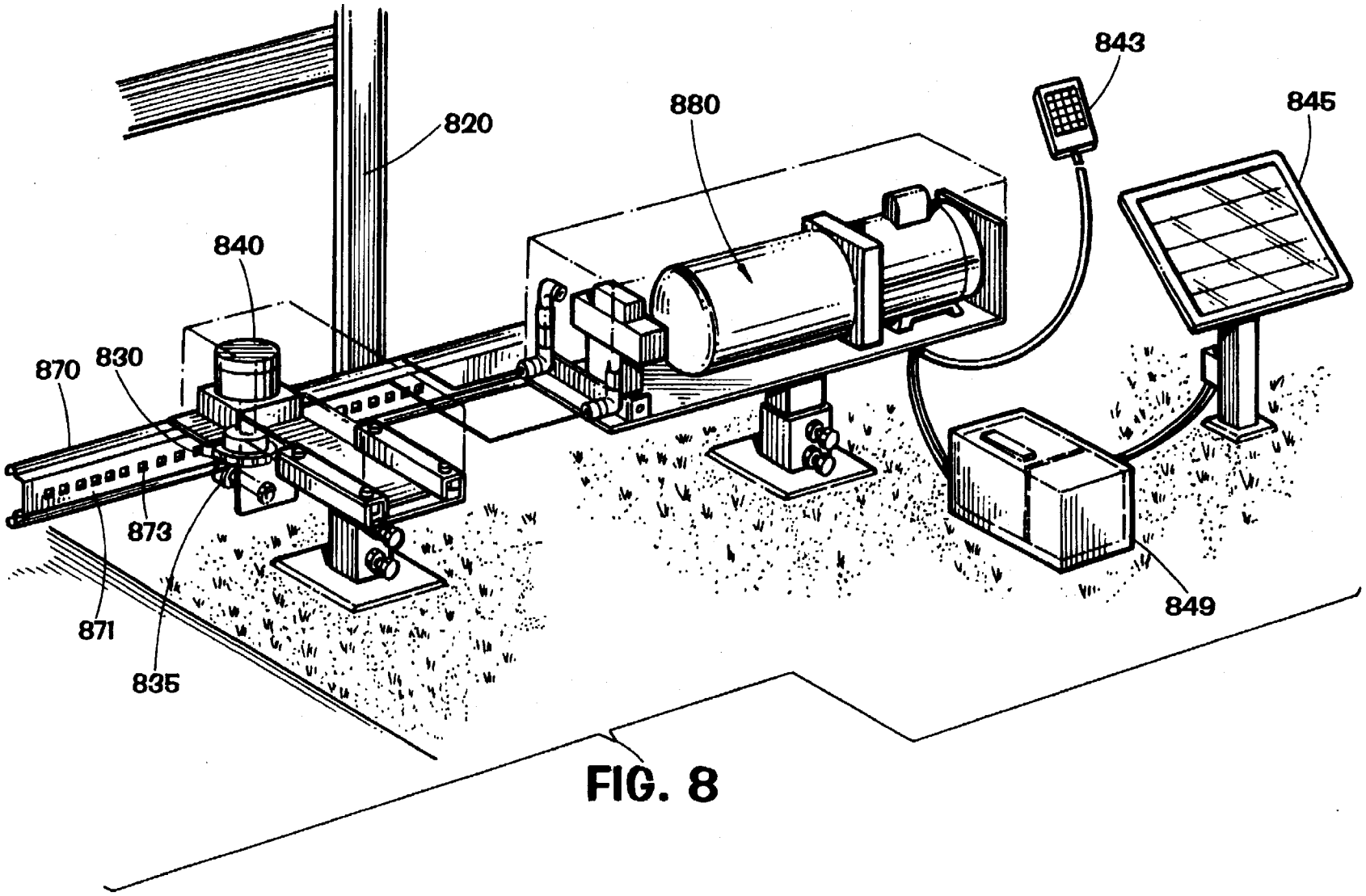
FIG. 8 is a perspective view of an alternative embodiment of the gate or door opening and closing system, in which the rigid strip has one planar surface.
Figure 9:
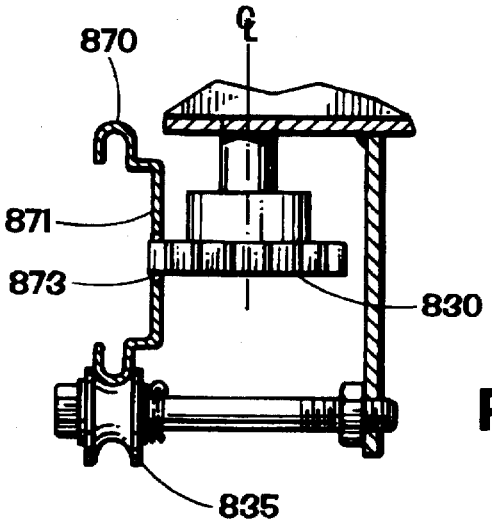
FIG. 9 is a detailed cross-sectional side view taken along line 9—9 of FIG. 8.

FIGS. 8 and 9 depict an alternative embodiment of the present invention in which the rigid strip 870 has only one substantially planar surface 871. In FIG. 8, the rigid strip 870 has its perforations 873 formed in a substantially vertical planar surface 871. In this embodiment, the rigid strip 870 is parallel to the gate 820, and the sprocket 830 rotates in a plane perpendicular to the gate 820. The sprocket 830, driven by a hydraulic motor 840, is powered by a hydraulic system 880. In addition solar power, collected by a solar panel 845, can be used to supply power to a battery 849 which in turn provides electric power to the hydraulic system 880. Such assembly is particularly suitable for remote locations where electric power is not readily available. A pad control 843 may be used to operate the system.

FIG. 9 shows a rotating bearing 835 with a spool shaped head. The rigid strip 870 is shaped such that it may ride in the rotating bearing 835.

Figure 10:
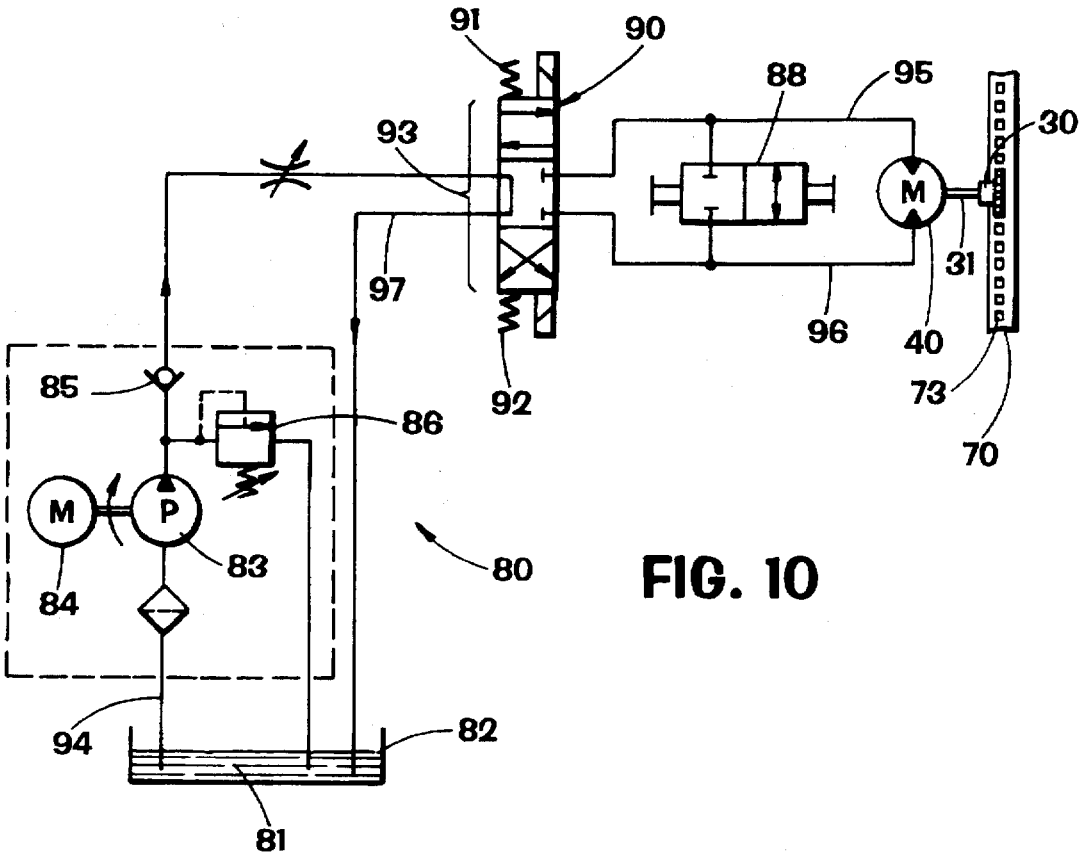
FIG. 10 is a schematic diagram of the hydraulic system used to rotate the sprocket.

FIG. 10 shows a circuit schematic diagram of the hydraulic system 80. In the preferred embodiment, hydraulic fluid 81 is stored in a reservoir 82. The reservoir 82 is connected to a pump 83 by a hydraulic fluid supply line 94. The pump 83 is activated by an electric motor 84. In the preferred embodiment, the motor 84 is a 110 VAC, 1 HP motor. The hydraulic system 80 also includes a load holding check valve 85, a spring loaded pressure relief valve 86, a speed control valve 87, and a crossover valve 88. The speed of the hydraulic motor 40 is regulated by controlling the rate of flow of hydraulic fluid with speed control valve 87. When the pump 83 is activated, the hydraulic fluid supply line 94 carries the hydraulic fluid 81 from the reservoir 82 to a solenoid controlled tandem center valve 90. The tandem center valve 90, which controls the direction of rotation of the hydraulic motor 40, is connected to the hydraulic motor 40 by two hydraulic fluid lines 95 and 96. In the preferred embodiment, the solenoid controlled valve 90 has two control coils 91 and 92 and a tandem center flow control portion 93. When the first coil 91 of the solenoid valve 90 is powered, the hydraulic fluid 81 passes from the supply line 94 through the flow control portion 93 in the solenoid valve 90 in a direct manner, thence into the line 95 and on to the hi-rotational hydraulic motor 40, which causes the motor 40 to rotate in one direction, and thus causes the gate 20 to open. After the hydraulic fluid 81 passes through the hydraulic motor 40, it then passes into the line 96, where it flows directly through the tandem center valve flow control portion 93 into the return line 97 and then returns to the reservoir 82. When the second coil 92 of the solenoid 90 is powered, the hydraulic fluid 81 passes from the supply line 94 through the tandem center valve flow control portion 93 in the solenoid valve 90 in a diagonal manner into the line 96 and then to the motor 40, which causes the motor 40 to rotate in the opposite direction, and thus causes the gate 20 to close. After the hydraulic fluid 81 passes through the hydraulic motor 40, it continues into the line 95, flows diagonally through the flow control portion 93 in the solenoid valve 90 into the return line 97 and then returns to the reservoir 82. When no power is supplied to either the first coil 91 or the second coil 92, the flow control portion 93 is centered, and no hydraulic fluid 81 will flow to the motor 40. The solenoid valve 90 can stop the hydraulic motor 40 in any position and simultaneously unload the pump 83 to save power. This feature allows the gate to be stopped in a partially open position which may serve to allow pedestrian traffic while excluding vehicular traffic. Activation of the hydraulic system 80 causes the motor 40 to turn its shaft 31, which causes the sprocket 30 to rotate. As the sprocket 30 rotates, the teeth 33 on the sprocket 30 sequentially engage the perforations 73 on the rigid strip 70 thus causing the gate or door to which the rigid strip 70 is mounted to open and close. The crossover valve 88 is in the closed position during normal operation when the hydraulic system 80 is being used to power the motor 40. When the crossover valve 88 is open, the hydraulic fluid 81 may flow between the motor 40 and the crossover valve 88, thus equalizing the pressure in the hydraulic fluid lines 95 and 96 and allowing the motor 40 to be manually rotated. This feature allows operation of the gate or door 20 in emergency situations.

Figure 11:
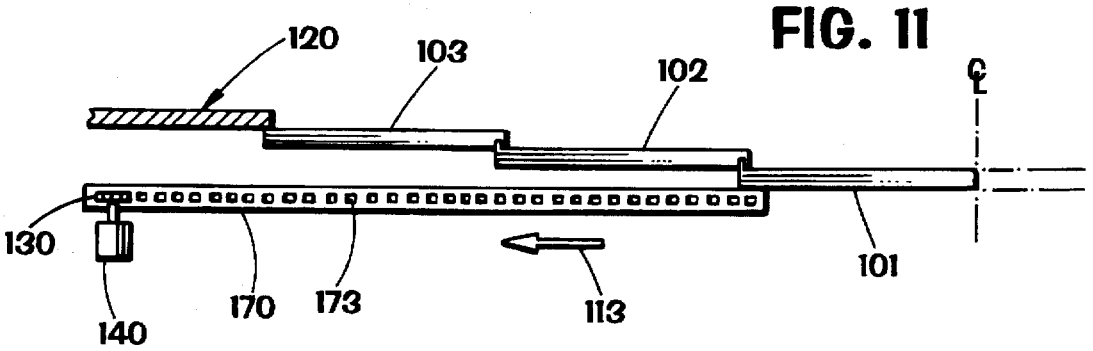
FIG. 11 illustrates an alternative embodiment of the system of the present invention adapted for use on a multi-section retractable door.

FIG. 11 shows adaptation of the system for opening a multi-section retractable gate or door 120. Herein, a rigid strip 170, having perforations 173 is attached by any durable means, including welding, screws, nuts and bolts, etc. to the first retractable section 101 of the gate or door 120. When the hydraulic motor 140 is activated it causes the sprocket 130 to rotate. As the sprocket 130 rotates, its teeth sequentially engage the perforations 173 in the rigid strip 170 which causes the first retractable section 101 to move into an overlapping position with the second retractable section 102 which then moves into an overlapping position with the third section 103 and so on, thus causing the multi-section retractable door to open (or close) along its horizontal path 113.

Alternatively, the rigid strip 170 may be mounted in the ground or to a portion of the building so that it remains stationary. The hydraulic motor 140 is then mounted to the first retractable door section 101. As the sprocket 130 rotates it carries both the hydraulic motor 140 and first retractable door section 101 across the rigid strip 170. As first retractable door section 101 becomes aligned with second retractable door section 102, stops on the door sections enable second retractable door section 102 to move with first retractable door sections 101 and so forth.

Figure 12:
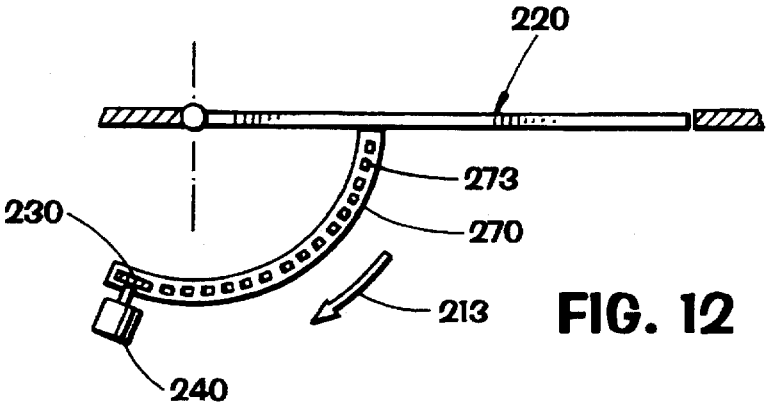
FIG. 12 illustrates an alternative embodiment of the system of the present invention adapted for use on a swinging gate or door.

FIG. 12 shows the system of the present invention adapted for a swinging gate or door 220. A curved rigid strip 270, having multiple perforations 273 formed therein is mounted to a gate or door 220 by any suitable means. Alternatively, rigid strip 270 may be straight if the hydraulic motor 240 is repositioned. When the hydraulic motor 240 is activated it causes a sprocket 230 to rotate which causes the teeth of the sprocket 230, to sequentially engage the multiple perforations 273 in a curved rigid strip 270 thus causing the swinging gate or door 220 to open and close along its swing path 213.

Figure 13A:
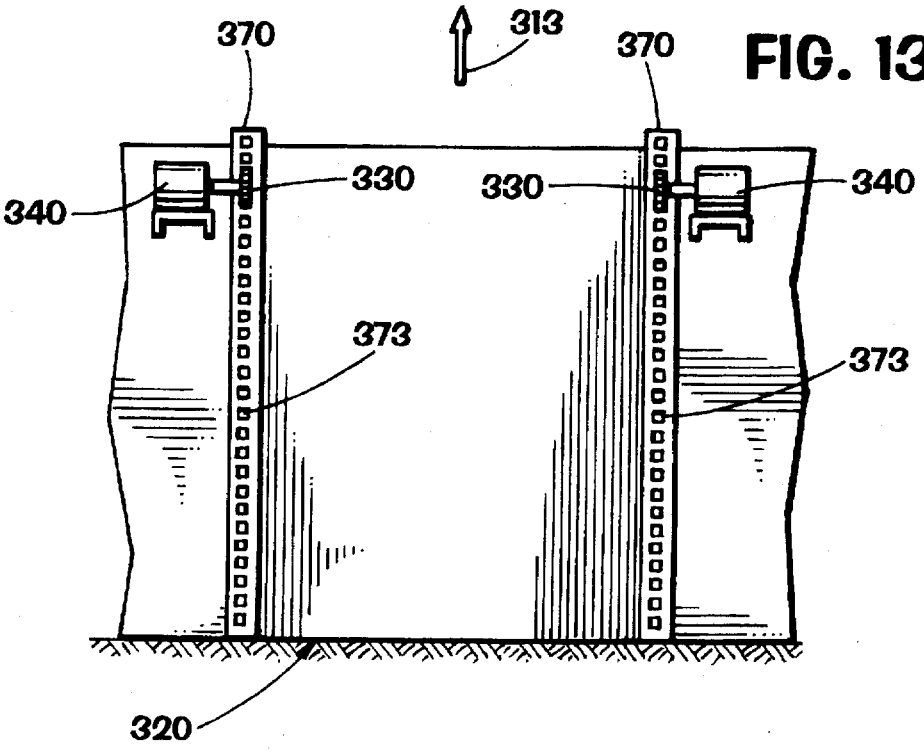
FIG. 13A illustrates an alternative embodiment of the system of the present invention adapted for use on an overhead gate or door.

FIG. 13A shows the system of the present invention adapted for an overhead or spillway gate or door 320. Herein, rigid strips 370 are mounted on each side of the overhead gate or door 320. Two hydraulic motors 340 and accompanying sprockets 330 are mounted adjacent to each side of the overhead gate or door 320. The two hydraulic motors 340 can be powered by a single hydraulic source, to operate in tandem with each other. When the two hydraulic motors 340 are activated, the two sprockets 330 rotate causing the teeth of the sprockets 330 to sequentially engage the perforations 373 in the rigid strips 370, which causes the overhead gate or door 320 to open and close along its vertical path 313.

Figure 13B:
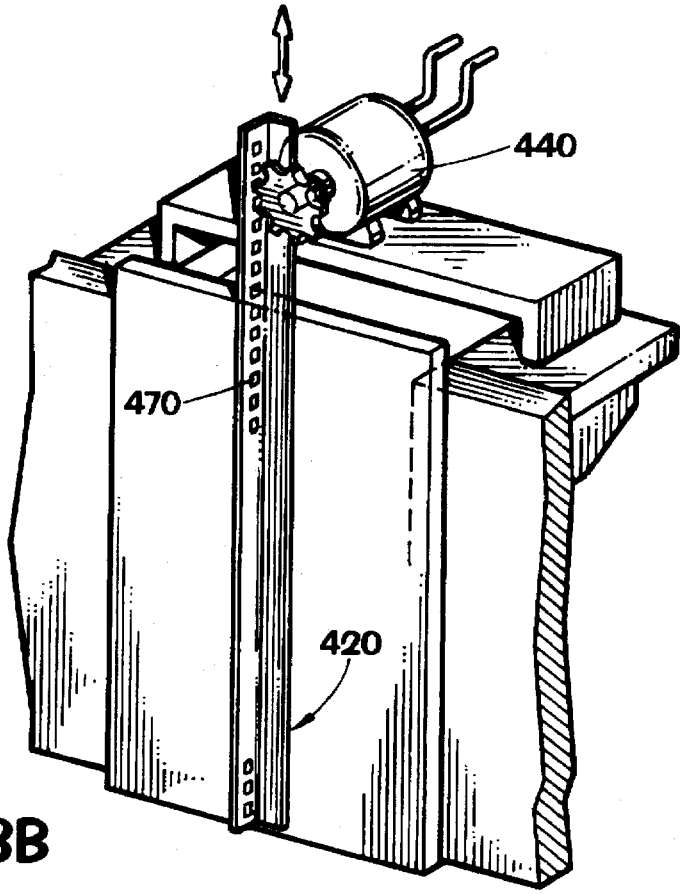
FIG. 13B illustrates an alternative configuration of the embodiment shown in FIG. 13A.

In FIG. 13B a single motor 440 and a single rigid strip 470 mounted in the middle of the overhead door or gate 420 are used.

Figure 13C:
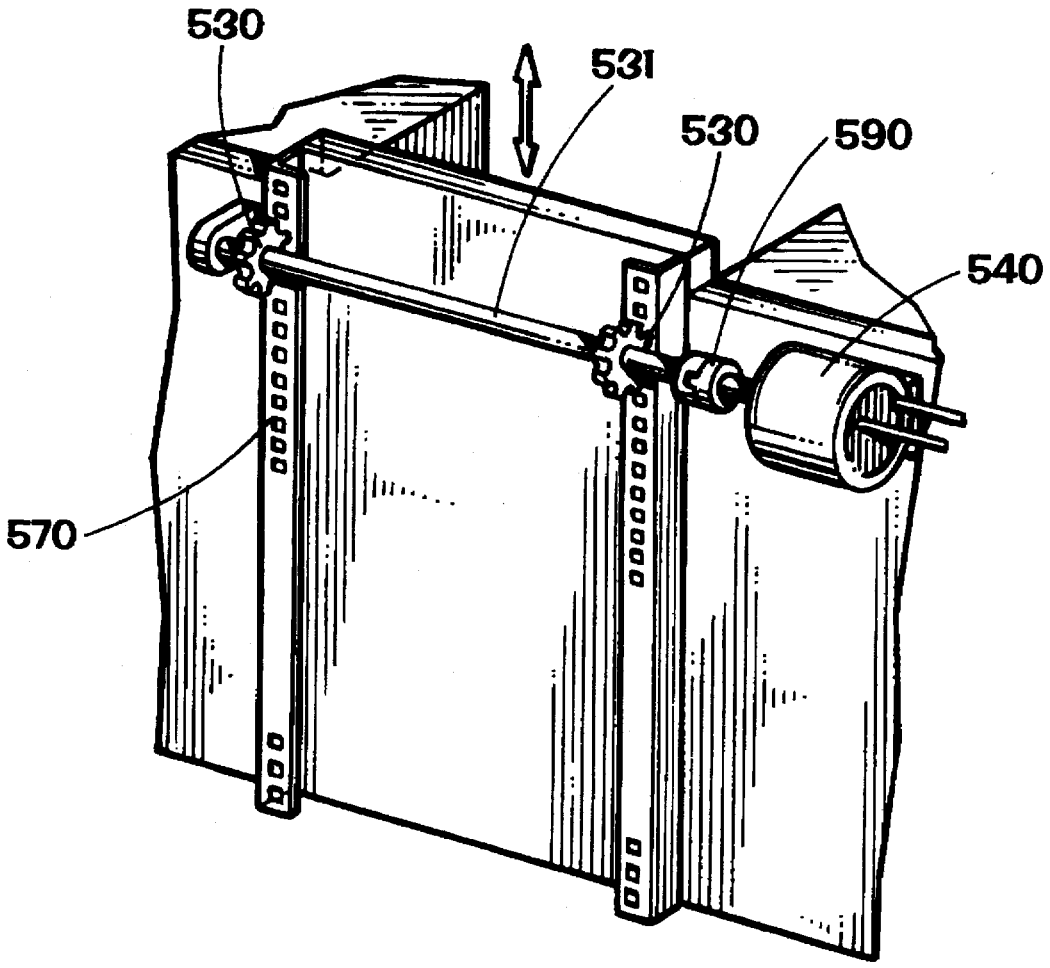
FIG. 13C illustrates yet another alternative configuration of the embodiment shown in FIG. 13A.

In FIG. 13C a single motor 540 having an elongated shaft 531 powers two sprockets 530, each of which engage a rigid strip 570. If desired, a flexible coupling 290 may be used between the elongated shaft 531 and the motor 540.

Changes and modifications to the specifically described embodiments can be carried out without departing from the scope of the invention which is intended to be limited only by the scope of the appended claims.

I claim the following:

1. An opening and closing system in combination with a sliding gate, said opening and closing system comprising:

a rotatable wheel having a plurality of projections extending radially therefrom;

a rigid strip of material, said rigid strip of material being an angle iron having two substantially planar surfaces, said first of said two substantially planar surfaces having a plurality of perforations for engagement by said projections of said rotatable wheel, and said second of said two substantially planar surfaces providing means for mounting said rigid strip of material to the sliding gate;

means for mounting said rigid strip of material to the sliding gate; and means for imparting rotary motion to said rotatable wheel so that said projections on said rotatable wheel sequentially engage said perforations in said rigid strip of material;

whereby the rotation of said rotatable wheel and said sequential engagement of said perforations in said rigid strip of material, causes the sliding gate to open and close.

2. The opening and closing system as defined in claim 1 wherein said rotatable wheel is a sprocket.

3. The opening and closing system as defined in claim 1, wherein said means for imparting rotary motion to said rotatable wheel is a hydraulic motor.

4. The opening and closing system as defined in claim 1, wherein said projections on said rotatable wheel engage said perforations in said rigid strip of material in an imprecise manner.

5. An opening and closing system in combination with a sliding gate, said system comprising:

a rotatable wheel having a plurality of projections extending radially therefrom;

a rigid strip of material, said rigid strip of material being an angle iron having two substantially planar surfaces, said first of two substantially planar surfaces having a plurality of perforations for engagement by said projections of said rotatable wheel and said second of said two substantially planar surfaces providing means for mounting said rigid strip of material to the sliding gate;

means for imparting rotary motion to said rotatable wheel so that said projections on rotatable wheel sequentially engage said perforations in said rigid strip of material; and means for urging said perforations in said rigid strip of materials into alignment with said projections on said rotatable wheel;

whereby the rotation of said rotatable wheel and said sequential engagement of said perforations in said rigid strip of material, causes the sliding gate to open and close.

6. The opening and closing system as defined in claim 5 wherein said rotatable wheel is a sprocket.

7. The opening and closing system as defined in claim 5 wherein said rigid strip of material is further constructed and arranged for riding on said means for urging said perforations in said rigid strip of material into alignment with said projections of said rotatable wheel as said rigid strip of material moves past said rotatable wheel.

8. The opening and closing system as defined in claim 5, wherein said means for imparting rotary motion to said rotatable wheel is a hydraulic motor.

9. The opening and closing system as defined in claim 5, wherein said projections of said rotatable wheel engage said perforations in said rigid strip of material in an imprecise matter.

10. The opening and closing system as defined in claim 5, wherein said means for urging said perforations in said rigid strip of material into alignment with said projections on said rotatable wheel is a roller.

11. An opening and closing system in combination with a sliding gate, said system comprising:

a rotatable sprocket having tapered teeth;

a rigid length of angle iron having two planar surfaces, said first of said two planar surfaces having perforations for penetration by the tapered teeth of said rotatable sprocket, said second of said two planar surfaces having means for mounting said rigid length of angle iron to the sliding gate;

a hydraulic power system for imparting rotation to said rotatable sprocket; and a roller for urging said rigid length of angle iron into alignment with said tapered teeth of said rotatable sprocket;

whereby said tapered teeth of said rotatable sprocket sequentially engage said perforations in said rigid length of angle iron causing the sliding gate to which said rigid length of angle iron is mounted to open and close.

12. The opening and closing system as defined in claim 11, said system further comprising:

a mounting platform for adjusting the horizontal and vertical position of said rotatable sprocket in relation to said rigid length of angle iron.

13. The opening and closing system as defined in claim 11, wherein said hydraulic power system includes:

means for activating and deactivating the rotation of said rotatable sprocket;

means for regulating the speed of rotation of said rotatable sprocket;

means for relieving hydraulic pressure which may build up in said hydraulic power system;

means for reversing the direction of rotation of said rotatable sprocket; and means for manually overriding said hydraulic power system.

14. An opening and closing system in combination with an overhead or spillway gate, said system comprising:

two rotatable wheels having a plurality of projections extending radially therefrom;

two rigid strips of material, each of said rigid strips of material being an angle iron having at least two substantially planar surfaces, the first of said two substantially planar surfaces having a plurality of perforations formed therein, said plurality of perforations constructed and arranged for engagement by said projections of said rotatable wheels, said second of said two substantially planar surfaces providing a mounting for said rigid strips of material;

means for imparting rotary motion to said rotatable wheels so that said projections on said rotatable wheels sequentiality engage said perforations in said two rigid strips of material;

said first of said two rigid strips of material being positioned to operate on a first side of the overhead or spillway gate, said second of said two rigid strips of material being positioned to operate on a second side of the overhead or spillway gate;

said first and second rotatable wheels operating in tandem with one another;

whereby the rotation of said first and second rotatable wheels and said sequential engagement of said perforations in said first and second rigid strips of material causes the overhead or spillway gate to open and close.

* * * * *